US005928830A

United States Patent [19]

Cheng et al.

[11] Patent Number: 5,928,830

[45] Date of Patent: Jul. 27, 1999

[54] LATEX PROCESSES

[75] Inventors: Chieh-Min Cheng, Rochester; Grazyna E. Kmiecik-Lawrynowicz, Fairport, both of N.Y.

[73] Assignee: Xerox Corporation, Stamford, Conn.

[21] Appl. No.: 09/031,345

[22] Filed: Feb. 26, 1998

[51] Int. Cl.[6] ..... G03G 9/087

[52] U.S. Cl. ..... 430/137

[58] Field of Search ..... 430/137, 106

[56] References Cited

U.S. PATENT DOCUMENTS

| | | | |
|---|---|---|---|
| 3,674,736 | 7/1972 | Lerman et al. | 260/41 R |
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |
| 5,827,633 | 10/1998 | Ong et al. | 430/137 |
| 5,853,943 | 12/1998 | Cheng et al. | 430/137 |
| 5,858,601 | 1/1999 | Ong | 430/137 |

*Primary Examiner*—John Goodrow
*Attorney, Agent, or Firm*—E. O. Palazzo

[57] ABSTRACT

1. A process for the preparation of a latex comprising a core polymer and a shell thereover and wherein said core polymer is generated by (A)

(i) emulsification and heating of the polymerization reagents of monomer, chain transfer agent, water, surfactant, and initiator;

(ii) generating a seed latex by the aqueous emulsion polymerization of a mixture comprised of part of the (i) monomer emulsion, from about 0.5 to about 50 percent by weight, and a free radical initiator, and which polymerization is accomplished by heating, and, wherein the reaction of the free radical initiator and monomer produces a seed latex containing a polymer;

(iii) heating and adding to the formed seed particles of (ii) the remaining monomer emulsion of (I), from about 50 to about 99.5 percent by weight of monomer emulsion of (i) and free radical initiator;

(iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator;

(ii) adding a free radical initiator and heating;

(iii) whereby there is provided said shell polymer.

26 Claims, No Drawings

LATEX PROCESSES

PENDING APPLICATION

Illustrated in copending application U.S. Ser. No. 960,754 (filed Oct. 29, 1998) D/97371, entitled "Surfactants", the disclosure of which is totally incorporated herein by reference are novel surfactants, that is cleavable or hydrolyzable surfactants of the Formulas (I), (II), or (III), and which surfactants, especially those of Formulas (I), (II), or mixtures thereof may be selected for the toner processes of the present invention.

BACKGROUND OF THE INVENTION

The present invention is generally directed to latex processes, and more specifically, to aggregation and coalescence or fusion of the latex generated, and which latex is comprised of a core and a shell thereover, with colorant, like pigment, dye, or mixtures thereof, and optional additive particles. In embodiments, the present invention is directed to toner processes which provide toner compositions with, for example, a volume average diameter of from about 1 micron to about 20 microns, and preferably from about 2 microns to about 10 microns, and a narrow particle size distribution of, for example, from about 1.10 to about 1.35 as measured by the Coulter Counter method, without the need to resort to conventional toner pulverization and classification methods. The resulting toners can be selected for known electrophotographic imaging and printing processes, including digital color processes, and more specifically for imaging processes, especially xerographic processes, which usually require high toner transfer efficiency, such as those with a compact machine design without a cleaning component, or those that are designed to provide high quality colored images with excellent image resolution, acceptable signal-to-noise ratio, and image uniformity, and for imaging systems wherein excellent glossy images are generated.

Aspects of the present invention relate to the preparation and design of a latex polymer with a core-shell structure, or core encapsulated within a shell polymer, and which structure possesses excellent fix and excellent gloss characteristics and wherein the structure can be generated by for example, semicontinuous methods, emulsion polymerization, consecutive emulsion polymerization sequences and the like. The latexes of core and shell which can be prepared by a single stage reaction are preferably of a unimodal molecular weight distribution and single glass transition temperature. A wide variety of latex polymers of for example, differing homopolymeric and copolymeric composition, such as styrene-butadiene-acrylic acid copolymers, styrene-butyl acrylate-acrylic acid copolymers, acrylic homopolymers and copolymers which possess specific chemical, mechanical and/or triboelectrical properties for toner applications can be generated.

There are a number advantages associated with the present invention, for example, in that by using core-shell latexes one can select the optimum properties of each of the core and shell resins, or polymes, such as gloss and fix, which otherwise may not readily obtainable by a single latex. Another advantage of the present invention is that the gloss and fix levels can be varied, (within the limits of individual polymer properties) by adjusting the glass transition temperature, molecular weight, or proportions of each polymer of the core and of the shell. The same principle is also applicable in obtaining glossy or matte finishes. For example, if resin A has a low molecular weight of about 5,000 to about 25,000 there could result for the developed image, an image gloss of greater than 50 gloss units, however the fix may be poor, wherein the MFT is higher than 190° C., or from about 195 to about 225 degrees Centigrade, while if resin B has a high molecular weight of about 40,000 to about 80,000, there could result a poor gloss of for example, an image gloss lower than about 50 gloss units, or from about 30 to about 45 gloss units, and fix wherein the MFT is lower than about 180° C., or from about 150° C. to about 175° C. By combining the above resins them into a core-shell latex, there can be obtained excellent fix and acceptable gloss.

In pictorial or process color applications, the properties of the toner resin such as gloss and fix are important to the attainment of high image quality. Unfortunately, a latex which has the desired fix properties may not yield acceptable gloss properties. For example, if a latex resin has a low molecular weight, that is for example, a Mw of about 5,000 to about 30,000, or lower, it would result in a developed toner image with an excellent gloss, of for example greater than 50 gloss units, such as 70 for high quality color applications (the gloss of the fused images was measured throughout according to TAPPI Standard T480 at a 75° C. angle of incidence and reflection using a Novo-Gloss Statistical Gloss Meter, Model GL-NG 1002S from Paul N. Gardner Company, Inc.), but poor fix, that is the MFT (minimum fixing temperature) is higher than about 190° C. to about 220° C. for the resulting toner. The degree of permanence of the fused images was evaluated throughout by the Crease Test (crease test data can be expressed as MFT), wherein the fused image is folded under a specific weight with the toner image to the inside of the fold. The image is then unfolded and any loose toner wiped from the resulting Crease with a cotton swab. The average width of the paper substrate, which shows through the fused toner image in the vicinity of the Crease, is measured with a custom built image analysis system. The fusing performance of a toner is judged from the fusing temperatures required to achieve acceptable image gloss and fix. For high quality color applications, an image gloss greater than 50 gloss units is preferred. The minimum fuser temperature required to produce a Crease value less than the maximum acceptable Crease is known as the Minimum Fix Temperature (MFT) for a given toner, In general, it is desirable to have an MFT as low as possible, such as for example MFT below 190° C., and preferably below 170° C. in order to minimize the power requirements of the hot roll fuser.) fix; if a latex has a high molecular weight, a Mw of about 35,000 to about 80,000, as determined by Gel Permeation Chromatrography (GPC), then it could result in a poor gloss and excellent fix.

One solution may be to blend various latexes especially designed for toner fix properties and for toner gloss properties, reference for example, U.S. Pat. No. 5,496,676. However, this would involve the addition of at least two latexes to an aqueous solution, and these processes possess inherent problems of limited compatibility between the two different latex resins when the two latex resins are incompatible, such as difference in the individual classes and/or species of the monomeric materials, or in particle surface properties, glass transition temperature, and molecular weight, and this in turn cause the resins to phase separate when heated together into domains rich in each resin, and form separately aggregated particles.

Another solution to preparing a latex having both acceptable gloss and fix is to copolymerize various monomers together; however, this is not always satisfactory primarily because toner gloss and fix are predominantly affected by the molecular weight of the latex in contrasting ways, that is when not using a core-shell polymer latex concept there does not result it is believed a latex polymer with bimodal or multiple modal molecular weight distribution, or a polymer latex with multiple Tg's, for example, a Tg of about 20° C. to about 50° C. in the polymeric core, and a Tg of about 51° C. to about 70° C. in the polymeric shell, as measured by Differential Scanning Calorimetry (DSC), and which can fulfill the requirements for both toner fix and gloss. Thus, the mere copolymerization of various monomers would not it is believed allow the adjustment of the molecular weights which is suitable for both toner fix and gloss applications.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process results in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of the above Xerox patents can be selected for the toner processes of the present invention in embodiments thereof.

SUMMARY OF THE INVENTION

It is a feature of the present invention to provide toner processes with many of the advantages illustrated herein.

More specifically a feature of the present invention relates to the preparation of latexes, and especially latexes particles having a core/shell morphology by a semicontinuous, consecutive emulsion polymerization in sequence with different monomers and wherein the second stage monomer is polymerized in the presence of seed latex particles, and which seed particles can be prepared in a separate step, or formed in situ and wherein there results latexes with appropriate Mn's, Mw's, and Tg's whereby the core polymer is for gloss and the shell polymer is for fix.

In another feature of the present invention there are provided simple and economical processes for the preparation of black and colored toner compositions with excellent colorant dispersions, thus enabling the achievement of excellent color print quality and which toners are prepared from latexes of a core and a shell thereover.

In a further feature of the present invention there is provided a process for the preparation of toner compositions, with a volume average diameter of from between about 1 to about 15 microns, and preferably from about 2 to about 10 microns, and a particle size distribution of about 1.10 to about 1.28, and preferably from about 1.15 to about 1.25 as measured by a Coulter Counter without the need to resort to conventional classifications to narrow the toner particle size distribution.

In a further feature of the present invention there is provided a process for the preparation of toner by aggregation and coalescence, or fusion (aggregation/coalescence) of latex, colorant, and additive particles.

In yet another feature of the present invention there are provided toner compositions with low fusing temperatures of from about 120° C. to about 180° C., and which toner compositions exhibit excellent blocking characteristics at and above about 45° C.

In still a further feature of the present invention there are provided toner compositions which provide high image projection efficiency, such as for example over 75 percent as measured by the Match Scan II spectrophotometer available from Million-Roy.

The present invention relates to the preparation of core-shell latexes. More specifically the present invention is directed to core-shell latexes prepared by a stepwise emulsion polymerization. The resulting latex polymer composition is thus comprised of a core-shell latex wherein the latex particles comprise for example, about 10 to 60 percent, and preferably about 20 to 50 percent, by weight of a polymeric core and for example, about 40 to 90 percent, and preferably about 50 to 80 percent, by weight of a polymeric shell thereover. The core is formed by emulsion polymerization of a first-stage monomer composition, and the shell is formed on the core by emulsion polymerization of a second-stage second dissimilar monomer that the core monomer composition, preferably in the presence of the core polymer. The monomers of the first monomer composition are selected in a manner to provide a glass transition temperature (Tg) in the core of for example, about 20° C. to about 50° C., and preferably about 30° C. to about 50° C., and a weight average molecular weight (Mw) of for example, about 5,000 to about 30,000, and preferably of for example, about 8,000 to about 25,000, and the second shell forming monomer composition which form the polymer shell that encapsulates the core are selected in a manner to provide a Tg in the shell of for example, about 50° C. to about 70° C., and preferably about 55° C. to about 65° C., and a Mw of 30,000 or higher, preferably of 40,000 or higher, such as about 40,000 to about 200,000. More specifically the process of the present invention relates to the preparation of a latex by a semi-continuous, stepwise emulsion polymerization sequence wherein the monomer mixture used to prepare the core and the shell polymers have different monomer compositions and for example dissimilar chain transfer concentrations. Specifically the core can be formed by first preparing an initial aqueous resin, or polymer latex with a resin glass transition temperature (Tg) of about 20° C. to about 50° C., and preferably about 30° C. to about 50° C., and a weight average molecular weight (Mw) of about 5,000 to about 30,000, and preferably of about 8,000 to about 25,000, by emulsion polymerization of a first (core) monomer composition by (i) conducting a pre-reaction monomer emulsification which comprises the emulsification of the polymerization reagents of monomers, chain transfer agent, water, surfactant, and an initiator, and wherein the emulsification is accomplished at a low temperature of, for example, from about 5° C. to about 40° C.;

(ii) preparing a seed particle latex by the aqueous emulsion polymerization of a mixture comprised of part of the monomer emulsion (i), from about 0.5 to about 50 percent by weight, and preferably from about 3 to about 25 percent by weight; and then adding it to a reactor containing a liquid solution of water, and surfactant or surfactants;

(iii) and adding to the monomer emulsion in (ii) an optional, but preferably free radical initiator, from about 0.5 to about 100 percent by weight, and preferably from about 3 to about 100 percent by weight of total initiator used to prepare the core copolymer resin, and heating at a temperature of from about 35° C. to about 125° C., wherein the reaction of the free radical initiator and monomer produces the seed latex comprised of latex resin (the reaction products of monomers and initiator; and wherein the particles are stabilized by surfactants);

(iv) heating and feed adding to the formed seed particles the remaining monomer emulsion (ii) from about 50 to about 99.5 percent by weight, and preferably from about 75 to about 97 percent by weight used to prepare the core copolymer, and free radical initiator, from about 0.5 to about 99.5 percent by weight, and preferably from about 1 to about 97 percent by weight of total initiator used to prepare the copolymer resin, and which heating is at a temperature from about 35° C. to about 125° C., and (v) retaining the above contents in for example, a reactor at a temperature of from about 35° C. to about 125° C. for an effective time period, for example from about 0.1 to about 10 hours, and preferably from about 0.5 to about 4 hours and subsequently generating the polymer shell, or coating. Also, the present invention relates to a process for the preparation of a latex comprising a core polymer and a shell thereover and wherein said core polymer is generated by (A)

(i) emulsification and heating of the polymerization reagents of monomer, chain transfer agent, water, surfactant, and initiator;

(ii) generating seed latex particles by the aqueous emulsion polymerization of a mixture comprised of part of the (i) monomer emulsion, from about 0.5 to about 50 percent by weight, and a free radical initiator, and which polymerization is accomplished by heating, and, wherein the reaction of the free radical initiator and monomer produces the seed latex containing a polymer;

(iii) heating and adding to the formed seed particles of (ii) the remaining monomer emulsion of (I), from about 50 to about 99.5 percent by weight of monomer emulsion of (i) and free radical initiator;

(iv) whereby there is provided the core polymer; and (B) forming a shell thereover said core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator;

(ii) adding a free radical initiator and heating;

(iii) whereby there is provided the shell polymer.

The shell can formed on the core by emulsion polymerization of a second monomer composition preferably in the presence of the core polymer. More specifically, there is polyminized a second (shell) monomer having a glass transition temperature in the shell of for example, about 50° C. to about 70° C., and preferably about 55° C. to about 65° C., and a weight average molecular weight of about 30,000 to about 100,000, and preferably of about 40,000 to about 80,000, by (i) conducting a pre-reaction monomer emulsification, which comprises emulsification of the polymerization reagents of monomers, and optional, but preferably a chain transfer agent, surfactant, and an initiator, and wherein the emulsification is accomplished at a low temperature of, for example, from about 5° C. to about 45° C.;

(ii) feed adding to the formed core latex particles the monomer emulsion used to prepare the shell copolymer, and an optional free radical initiator, from about 0.5 to about 99.5 percent by weight, and preferably from about 0 to about 97 percent by weight of total initiator used to prepare the shell copolymer resin, and heating at a temperature of for example, from about 35° C. to about 125° C., and (iii) retaining the resulting mixture at a temperature of for example, from about 35° C. to about 125° C. for an effective time period, for example from about 0.5 to about 6 hours, and preferably from about 1 to about 4 hours, followed by cooling to about room temperature, and wherein there results the desired core-shell latex comprised of a polymer core having a glass transition temperature (Tg) of for example, about 20° C. to about 50° C., and preferably about 30° C. to about 50° C., and a weight average molecular weight (Mw) of for example, about 5,000 to about 30,000, and preferably of about 8,000 to about 25,000, a polymer shell with for example, a glass transition temperature of about 50° C. to about 70° C., and preferably about 55° C. to about 65° C., and a weight average molecular weight of for example, about 30,000 to about 100,000, and preferably about 40,000 to about 80,000, and wherein the polymer shell possesses a suitable thickness of for example, about 0.01 microns to about 0.3 microns, and preferably of about 0.03 microns to about 0.2 microns.

The core-shell latexes can be prepared by a semi-continuous, and consecutive emulsion polymerization sequences wherein the monomer mixture used to prepare the core and the shell polymers have different monomer compositions or chain transfer agent concentrations. More specifically the core can be formed by first preparing an initial aqueous resin latex wherein the resin possesses a glass transition temperature (Tg) of about 50° C. and preferably about 30° C. to about 50° C., and a weight average molecular weight (Mw) of about 5,000 to about 30,000, and preferably of about 8,000 to about 25,000, by emulsion polymerization of a first (core) monomer composition by (i) accomplishing a pre-reaction monomer emulsification, which comprises emulsification of the polymerization reagents of monomers, chain transfer agent, water, surfactant, and an initiator, and wherein the emulsification is accomplished at a temperature of, for example, from about 5° C. to about 40° C.;

(ii) preparing seed latex particles by an aqueous emulsion polymerization of a mixture comprised of part of the monomer emulsion, from about 0.5 to about 50 percent by weight, and preferably from about 3 to about 25 percent by weight of monomer emulsion prepared in (i);

(iii) adding to the monomer emulsion in (ii) a free radical initiator, from about 0. 5 to about 100 percent by weight, and preferably from about 3 to about 100 percent by weight of total initiator used to prepare the core polymer resin, and heating at a temperature of from about 35° C. to about 125° C., wherein the reaction of the free radical initiator and monomer produces the seed latex comprised of latex resin (the reaction products of monomers and initiator; and wherein the particles are stabilized by surfactants);

(iv) heating and feed adding to the formed seed latex the remaining monomer emulsion, from about 50 to about 99.5 percent by weight, and preferably from about 75 to about 97 percent by weight of monomer emulsion prepared in (ii) used to prepare the core copolymer, and free radical initiator, and which heating is at a temperature of for example, from about 35° C. to about 125° C., and (v) retaining the resulting mixture at a temperature of from about 35° C. to about 125° C. for an effective time period, for example from about 0.1 to about 2 hours, and preferably from about 0.5 to about 4 hours, and wherein there results a core comprised of a polymer of for example, styrene, butadiene, isoprene, (meth)acrylates esters, acrylonitrile, (meth)acrylic acid, or mixtures thereof and wherein the polymer optionally possess a glass transition temperature (Tg) of about 20° C. to about 50° C., and a weight average molecular weight (Mw) of about 5,000 to about 30,000.

The shell is formed on the core by emulsion polymerization of a second different monomer than is selected for the core, however the core and shell can be similar or dissimilar in monomer compositions. The Tg and Mw of the polymer core usually and preferably differ from the Tg and Mw of the polymer shell. When the core and the shell have an identical monomer, and thus polymer composition, and the ratio of the constituents is identical, then the core and the shell can possess different Tg and Mw by using a different amount of chain transfer agent, such as 1-dodecanthiol. More specifically the shell can be formed by polymerizing a second (shell) monomer having a glass transition temperature in the shell of about 50° C. to about 70° C., and preferably about 55° C. to about 65° C., and a weight average molecular weight of about 30,000 to about 200,000, and preferably of about 40,000 or to about 80,000, in the presence of the first prepared core polymer latex by emulsion polymerization of by conducting a pre-reaction monomer emulsification, which comprises emulsification of the polymerization reagents of monomers, and optional, but preferably a chain transfer agent, surfactant, and an initiator, and wherein the emulsification is accomplished at a low temperature of, for example, from about 5° C. to about 40° C.;

(ii) feed adding to the formed core latex particles comprised for example, of a polymer of styrene, butadiene, isoprene, (meth)acrylates esters, acrylonitrile, (meth)acrylic acid, and mixtures thereof and wherein in the core latex, the core resin particulates are typically present in amounts of from about 5 to about 50, and preferably from about 20 to about 40 percent by weight, the water (the dispersing medium) is present in amounts of typically from about 50 to about 94, and preferably from about 60 to about 80 percent by weight, and wherein surfactant amounts typically range from about 0.01 to about 10, preferably from about 0.5 to about 5 percent by weight, and residual initiator and chain transfer agents and fragments thereof amounts typically range from about 0.01 to about 10, and preferably from about 0.05 to about 5 percent by weight of the total emulsion polymerization mixture for preparing the core latex, and (iii) retaining the resulting components at a temperature of from about 35° C. to about 125° C. for an effective time period, for example from about 0.5 to about 6 hours, and preferably from about 1 to about 4 hours, followed by cooling and wherein these results a core/shell latex comprised of about 10 to 60 percent, and preferably 20 to 50 percent, by weight of a polymeric core and about 40 to 90 percent, percent 50 to 80 percent, by weight of a polymeric shell thereover, and wherein the polymer shell has a thickness of for example, about 0.01 microns to about 0.3 microns, and preferably of about 0.03 microns to about 0.2 microns. Embodiments of the present invention also include a process wherein the addition of the shell monomer emulsion to the core latex particles is accomplished in a time period of about 0.5 to about 8 hours, and preferably about 1 to about 5 hours, and wherein the core latex particles generated can be of average particle size, such as from about 0.05 to about 0.5 micron, and preferably from about 0.1 to about 0.3 micron in volume average diameter as measured by the light scattering technique on a Coulter N4 Plus Particle Sizer.

The preferred monomers for the polymeric core include styrene, butadiene, isoprene, acrylates, methacrylates, acrylonitrile, acrylic acid, methacrylic acid, and mixtures thereof, and the preferred monomers for the polymeric shell include styrene, acrylates, methacrylates, acrylonitrile, acrylic acid, methacrylic acid, and the mixtures thereof. Preferred polymers formed for the core include poly (styrene-butadiene), poly(methyl methacrylate-butadiene), poly(ethyl methacrylate-butadiene), poly(propyl methacrylate-butadiene), poly(butyl methacrylate-butadiene), poly(styrene-isoprene), poly(methyl methacrylate-isoprene), poly(ethyl methacrylate-isoprene), poly(propyl methacrylate-isoprene), poly(butyl methacrylate-isoprene), poly(styrene-propyl acrylate), poly (styrene-butyl acrylate), poly(styrene-2-ethylhexyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly( methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid), and the preferred polymers for the shell include poly(styrene-butadiene), poly(methyl methacrylate-butadiene), poly(styrene-isoprene), poly (methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid).

Aspects of the present invention include a process for the preparation of a latex comprising forming a (A) core polymer from an aqueous latex containing at least water and a polymer of for example, styrene, butadiene, isoprene, (meth) acrylates esters, acrylonitrile, (meth)acrylic acid, or mixtures thereof, and wherein the polymer possesses for example, a glass transition temperature (Tg) of about 20° C. to about 50° C., and a weight average molecular weight (Mw) of about 5,000 to about 30,000, and which polymer is present in an amount of from about 5 to about 50, the water is present in an amount of from about 50 to about 94; in an amount of from about 0.01 to about 10, percent by weight, initiator, and chain transfer agent each present in an amount of about 0.01 to about 10 percent by weight of the latex mixture and which latex is generated by the emulsion polymerization of a first core monomer by (i) emulsification of the polymerization reagents of monomer, chain transfer agent, water, surfactant, and initiator, and wherein the emulsification is accomplished at a low temperature of from about 5° C. to about 40° C.;

(ii) generating a seed latex by the aqueous emulsion polymerization of a mixture comprised of part of the (i) monomer emulsion, from about 0.5 to about 50 percent by weight, and a free radical initiator, from about 0.5 to about 100 percent by weight of total initiator used to prepare the core polymer resin, which polymerization is accomplished, at a temperature of from about 35° C. to about 125° C. and, wherein the reaction of the free radical initiator and monomer generates the seed latex;

(iii) heating and adding to the formed seed particles of (ii) the remaining monomer emulsion from about 50 to about 99.5 percent by weight of monomer emulsion of (i) and free radical initiator, from about 0 to about 99.5 percent by weight of total initiator used to prepare the polymer resin and which heating is at a temperature from about 35° C. to about 125° C., and (iv) retaining the above mixture of (iii) at a temperature of from about 35° C. to about 125° C. to provide the core polymer comprised of for example, known polymers such as, styrene, butadiene, isoprene, (meth)acrylates esters, acrylonitrile, (meth)acrylic acid, of mixtures thereof and wherein the core polymer possesses a glass transition temperature (Tg) of about 20° C. to about 50° C., and a weight average molecular weight (Mw) of about 5,000 to about 30,000, and;

(B) forming a shell thereover the core generated polymer and which shell is generated by emulsion polymerization of a second monomer, in the presence of the core polymer by polymerizing a second monomer with a glass transition temperature of for example, about 50° C. to about 70° C., and a weight average molecular weight of for example, about 30,000 to about 100,000, which emulsion polymerization is accomplished by (i) emulsification of monomer, chain transfer agent, surfactant, and initiator, and wherein the emulsification is accomplished at a low temperature of for example, from about 5° C. to about 40° C.;

(ii) adding over a suitable period of time, for example about 0.5 to about 10 hours, a free radical initiator, from about 1 to about 99.5 percent by weight, and heating at a temperature from about 35° C. to about 125° C., and (iii) retaining the resulting core-shell polymer colloid dispersed in water at a temperature of from about 35° C. to about 125° C. for a period of for example, about 0.5 to about 6 hours, followed by cooling and wherein in the resulting core-shell polymer latex, the core-shell polymer is present in an amount of for example, from about 5 to about 60 percent by weight, the water is present in an amount of from about 40 to about 94 percent by weight, the surfactant is present in an amount of from about 0.01 to about 10 percent by weight, and residual initiator and chain transfer agents and fragments thereof are each present in an amount of about 0.01 to about 5 percent by weight of the total emulsion polymerization mixture, the polymer core possesses for example, a glass transition temperature (Tg) of about 20° C. to about 50° C., and a weight average molecular weight (Mw) of about 5,000 to about 30,000, the d polymer shell possessing a glass transition temperature of about 50° C. to about 70° C., and a weight average molecular weight of about 30,000 to about 100,000, wherein the polymer shell possesses a thickness of about 0.01 microns to about 0.3 microns, and wherein the latex formed is comprised of a core of a polymer comprising for example, styrene, butadiene, isoprene, (meth)acrylates esters, acrylonitrile, (meth)acrylic acid, and mixtures thereof and a shell of a polymer comprising for example, styrene, (meth)acrylates esters, acrylonitrile, (meth)acrylic acid, and mixtures thereof, and wherein the core and shell polymer are dissimilar; a process wherein the core polymer with a glass transition temperature (Tg) of about 30° C. to about 50° C., possesses a weight average molecular weight (Mw) of about 8,000 to about 25,000, and the core latex contains about 50 to about 90 percent by weight of water, and from about 65 to about 95 of surfactant, wherein the (ii) seed particle latex contains from about 3 to about 25 percent by weight of the emulsion prepared in (i); adding to the core monomer emulsion in (ii) a free radical initiator in an amount of about 3 to about 100 percent by weight of total initiator used to prepare the core polymer resin, (iv) heating and feed adding to the formed core seed particles of (iii) the remaining monomer emulsion from about 75 to about 97 percent by weight of monomer emulsion prepared in (ii) and free radical initiator from about 0 to about 97 percent by weight of total initiator used, and retaining the mixture at a temperature of from about 35° C. to about 125° C. for from about 0.1 to about 10 hours; a process wherein a toner is prepared by heating a mixture of a polymer latex with a core-shell structure, or a polymeric colloid comprised of a latex of polymeric core encapsulated in a polymeric shell, and a colorant dispersion below about or equal to about the polymer latex glass transition temperature to form aggregates, followed by heating above about or equal to about the polymer glass transition temperature to coalesce or fuse the aggregates; a process wherein the toner latex contains an ionic surfactant, a water soluble initiator and a chain transfer agent; adding anionic surfactant to substantially retain the size of the toner aggregates formed, or minimize the growth of the aggregates; thereafter coalescing or fusing the aggregates by heating; and optionally cooling, isolating, washing, and drying the toner; a process wherein cooling, isolating, washing and drying is accomplished; a process wherein the core-shell latex surfactant is selected in an amount of from about 0.05 to about 10 weight percent based on the total amount of monomers used to prepare the core-shell latex resin; a process wherein the temperature at which the aggregation is accomplished controls the size of the aggregates which temperature is below the resin glass transition temperature, and wherein the final toner size is from about 2 to about 15 microns in volume average diameter; a process wherein the aggregation temperature is from about 45° C. to about 55° C., and wherein the coalescence or fusion temperature is from about 85° C. to about 95° C.; a process wherein the colorant is a pigment and wherein said pigment dispersion contains an ionic surfactant, and the latex contains an ionic surfactant of opposite charge polarity to that of ionic surfactant present in the colorant dispersion; a process wherein a surfactant is utilized in the generation of the colorant dispersion, and which surfactant is a cationic surfactant, an anionic surfactant is present in the toner generating latex mixture, wherein the aggregation is accomplished at a temperature of about 15° C. to about 1° C. below the Tg of the latex resin for a duration of from about 0.5 hour to about 3 hours; and wherein the coalescence or fusion of the components of aggregates for the formation of integral toner particles comprised of colorant, and resin is accomplished at a temperature of from about 85° C. to about 95° C. for a duration of from about 1 hour to about 5 hours; a process wherein the there is selected for the core polymer poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate-acrylic acid), poly(alkyl methacrylate-acrylic acid), poly(styrene-alkyl acrylate-acrylonitrile-acrylic acid), poly (styrene-1, $^{3}$-diene-acrylonitrile-acrylic acid), and poly (alkyl acrylate-acrylonitrile-acrylic acid), and a shell polymer of poly(styrene-butadiene), poly(alkyl methacrylate-butadiene), poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1, 3-diene-acrylonitrile-acrylic acid), or poly(alkyl acrylate-acrylonitrile-acrylic acid), and wherein the core polymer is present in an amount of from about 10 to about 60 weight percent, or parts, and the shell polymer is present in an amount of form about 40 to about 90 weight percent or parts; a process wherein there is selected for the core polymer poly(styrene-butadiene), poly(methyl methacrylate-butadiene), poly(ethyl methacrylate-butadiene), poly(propyl 20 methacrylate-butadiene), poly(butyl methacrylate-butadiene), poly(styrene-isoprene), poly(methyl methacrylate-isoprene), poly(ethyl methacrylate-isoprene), poly(propyl methacrylate-isoprene), poly(butyl methacrylate-isoprene), poly(styrene-propyl acrylate), poly (styrene-butyl acrylate), poly(styrene-2-ethylhexyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), poly(styrene-butyl acrylate-acrylononitrile-acrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid); Wherein the shell polymer selected for the process of the present invention include known polymers such as poly(styrene-butadiene), poly (methyl methacrylate-butadiene), poly(styrene-isoprene), poly(methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly (methyl methacrylate-butadiene-methacrylic acid), poly (methyl methacrylate-butadiene-acrylonitrile-acrylic acid), poly(methyl methacrylate-butyl acrylate-acrylic acid), poly (methyl methacrylate-butyl acrylate-methacrylic acid), poly (methyl methacrylate-butyl acrylate-acrylononitrile), or poly(styrene-butyl acrylate-acrylononitrile-acrylic acid), and wherein similar polymers can also be selected for the shell polymer, and wherein the colorant is a pigment; a process wherein the ionic surfactant is an anionic surfactant selected from the group consisting of sodium dodecyl sulfate, sodium dodecylbenzene sulfate sodium dodecylnaphthalene sulfate, and sodium tetrapropyl diphenyloxide disilfonate; a process wherein the colorant is black, cyan, yellow, magenta, red, blue, green, or mixtures thereof; a process wherein the toner particles isolated are from about 2 to about 10 microns in volume average diameter, and the particle size distribution thereof is from about 1.15 to about 1.30; a process wherein there is added to the surface of the formed toner metal salts, metal salts of fatty acids, silicas, metal oxides, or mixtures thereof, each in an amount of from about 0.1 to about 10 weight percent of the obtained toner particles; a process wherein there is accomplished heating the resulting mixture below about, the glass transition temperature of the latex polymer; thereafter heating the resulting aggregates above about, the glass transition temperature of the resin; and cooling, isolating, washing and drying the toner; a process wherein the toner is of a volume average diameter of from about 1 to about 20 microns; a process for the preparation of a latex comprised of a core and a shell thereover comprising (A) generating a core polymer latex by (i) emulsification of the monomer, chain transfer agent, water, surfactant, and initiator, and wherein the emulsification is accomplished at a temperature of from about 5° C. to about 40° C.; and optionally mixing with a liquid composition comprising water, and surfactant;.

(ii) preparing a seed particle latex by aqueous emulsion polymerization of a mixture comprised of part of the (i) monomer emulsion, from about 0.5 to about 50 percent by weight;

(iii) adding to the monomer emulsion in (i) a free radical initiator, from about 0.5 to about 100 percent by weight of total initiator used to prepare the core polymer resin, at a temperature of from about 35° C. to about 125° C., wherein the reaction of the free radical initiator and monomer produces the seed latex comprised of latex resin, the reaction product of monomer and initiator, and wherein the particles are stabilized by such surfactant);

(iv) heating and feed adding to the formed seed particles of (iii) the remaining monomer emulsion from about 50 to about 99.5 percent by weight of monomer emulsion prepared in (ii) and free radical initiator, from about 0 to about 99.5 percent by weight of total initiator at a temperature from about 35° C. to about 125° C., and (v) retaining the above mixture at a temperature of from about 35° C. to about 125° C. to provide said core polymer latex comprised of a polymer comprising styrene, butadiene, isoprene, (meth)acrylates esters, acrylonitrile, (meth)acrylic acid, and mixtures thereof, wherein the core polymer glass transition temperature (Tg) is about 20° C. to about 50° C., with a weight average molecular weight (Mw) of about 5,000 to about 30,000, and wherein the core latex, the polymer is present in an amount of from about 5 to about 50, or from about 20 to about 40 percent by weight, the water is present in an amount of from about 50 to about 94, or from about 60 to about 80 percent by weight, said surfactant amount is from about 0.01 to about 10, or from about 0.5 to about 5 percent by weight, and said initiator, chain transfer agent, and fragments thereof are each present in an amount of from about 0.01 to about 10, or from about 0.05 to about 5 percent by weight of the total emulsion polymerization mixture, and; (B) forming a shell thereover in the presence of the core polymer and which shell is generated by the emulsion polymerization of a second monomer by polymerizing said second monomer possessing a glass transition temperature of about 50° C. to about 70° C., or about 55° C. to about 65° C., and a weight average molecular weight of about 30,000 to about 100,000, or about 40,000 to about 80,000, (i) conducting a pre-reaction monomer emulsification which comprises emulsification of the polymerization reagents of monomer, chain transfer agent, surfactant, and an initiator, and wherein said emulsification is accomplished at a low temperature of from about 5° C. to about 40° C.;

(ii) feed adding to the formed core latex particles the shell monomer emulsion of (1), and an optional free radical initiator, from about 0 to about 99.5 percent by weight, or from about 0 to about 97 percent by weight of total initiator used to prepare the shell polymer resin, at a temperature from about 35° C. to about 125° C., and (iii) retaining the above core-shell polymer emulsion at a temperature of about 95° C. to about 125° C. and wherein there results a core-shell polymer latex comprising a polymer core having a glass transition temperature (Tg) of about 20° C. to about 50° C., and a weight average molecular weight (Mw) of about 5,000 to about 30,000, a polymer shell having a glass transition temperature of about 50° C. to about 70° C., and a weight average molecular weight of about 30,000 to about 100,000, wherein the polymer shell possesses a thickness of about 0.01 microns to about 0.3 microns.

The present invention further relates to emulsion/aggregation/coalescence toner processes wherein the latexes generated by the processes illustrated herein can be selected for the preparation of toners and wherein washing of the toner to eliminate, or substantially remove surfactants is minimized, and wherein in embodiments the surfactant selected, especially for the latex, is a cleavable nonionic surfactant of copending application U.S. Ser. No. 960,754, and more specifically, represented by the following Formulas (I) or (II), or mixtures thereof

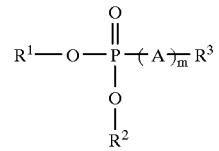

(I)

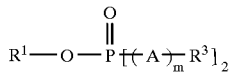

(II)

wherein $R^1$ is a hydrophobic aliphatic/aromatic group of, for example, alkyl, aryl, an alkylaryl, or an alkylaryl group with, for example, a suitable substituent, such as halogen like fluorine, chlorine, or bromine, wherein alkyl contains, for example, from about 4 to about 60 carbon atoms and aryl contains from, for example, about 6 to about 60 carbon atoms; $R^2$ can be selected from the group consisting of hydrogen, alkyl, aryl, alkylaryl, and alkylarylalkyl wherein each alkyl may contain, for example, from 1 to about 6 carbon atoms; $R^3$ is hydrogen or alkyl of, for example, 1 to about 10 carbon atoms; A is a hydrophilic polymer chain of polyoxyalkylene, polyvinyl alcohols, poly(saccharides), and more specifically, poly(oxyalkylene glycols) being selected, for example, from the group consisting of at least one of the heteric, block or homopolymer polyoxyalkylene glycols derived from the same or different alkylene oxides; wherein m is an integer, or a number of from, for example, about 2 to about 500, or about 5 to about 100, and wherein in embodiments the weight average molecular weight, Mw of A is, for example, from about 100 to about 300, or from about 104 to about 2,500, and which A is available from Aldrich Chemicals. Specific examples of the clevable surfactants are poly(ethylene glycol) methyl p-tert-octylphenyl phosphate, poly(ethylene glycol)-a-methyl ether-o-methyl p-tert-octylphenyl phosphate, poly(ethylene glycol) methyl decylphenyl phosphate, poly(ethylene glycol)-α-methyl ether-ω-methyl dodecylphenyl phosphate, poly (ethyleneglycol) methyl dodecylphenyl phosphate, bis[poly (ethylene glycol)-α-methyl ether]-•-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-•-ethyl p-tert-octylphenyl phosphate, poly(ethylene glycol) phenyl p-tert-octylphenyl phosphate, poly(ethylene glycol)-α-methyl ether-•-phenyl p-tert-octylphenyl phosphate, poly(ethylene glycol) tolyl p-tert-octylphenyl phosphate, poly(ethylene glycol)-α-methyl ether-•-tolyl p-tert-octylphenyl phosphate, and poly(ethylene oxide-co-propylene oxide) methyl p-tert-octylphenyl phosphate, and preferably wherein the polymer chain contains from about 5 to about 50 repeating units or segments; wherein there are selected the core-shell latexes generated by the processes illustrated herein and wherein the temperature of aggregation can be selected to control the aggregate size, and thus the final toner particle size, and the coalescence temperature and time can be utilized to control the toner shape and surface properties, and wherein the latex emulsion possesses submicron resin particles in the size range of for example, from about 0.05 to about 0.3 (from about to about includes are values therebetween throughout) micron in volume average diameter and wherein the latex contains an ionic surfactant, a water soluble initiator and a chain transfer agent; adding anionic surfactant to retain the size of the toner aggregates formed; thereafter coalescing or fusing said aggregates by heating; and optionally isolating, washing, and drying the toner; a process wherein the temperature at which the aggregation is accomplished controls the size of the aggregates, and wherein the final toner size is from about 2 to about 15 microns in volume average diameter; a process wherein the aggregation temperature is from about 45° C. to about 55° C., and wherein the coalescence or fusion temperature is from about 85° C. to about 95° C.; a process wherein the colorant is a pigment and wherein said pigment dispersion contains an ionic surfactant, and the latex emulsion contains said surfactant and which surfactant is a cleavable nonionic surfactant of Formulas I or 11, and an ionic surfactant of opposite charge polarity to that of ionic surfactant present in said colorant dispersion; a process wherein the surfactant utilized in preparing the colorant dispersion is a cationic surfactant, and the ionic surfactant present in the latex mixture is an anionic surfactant; wherein the aggregation is accomplished at a temperature about 15° C. to about 1° C. below the Tg of the latex resin for a duration of from about 0.5 hour to about 3 hours; and wherein the coalescence or fusion of the components of aggregates for the formation of integral toner particles comprised of colorant, and resin additives is accomplished at a temperature of from about 85° C. to about 95° C. for a duration of from about 1 hour to about 5 hours; a process wherein the first core polymer is selected from the group consisting of poly(styrene-butadiene), poly(alkyl acrylate-butadiene), poly(alkyl methacrylate-butadiene), poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and wherein said second shell polymer is selected from the group consisting of poly (styrene-butadiene), poly(alkyl methacrylate-butadiene), poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and wherein said colorant is a pigment; wherein said core-shell latex resin is present in an effective amount of from about 80 percent by weight to about 98 percent by weight of toner, a process wherein the core latex resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(styrene-isoprene), poly(methyl methacrylate-isoprene), poly(ethyl methacrylate-isoprene), poly(propyl methacrylate-isoprene), poly(butyl methacrylate-isoprene), poly(styrene-propyl acrylate), poly (styrene-butyl acrylate), poly(styrene-2-ethylhexyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid), the shell is selected from the group consisting of poly(styrene-butadiene), poly(methyl methacrylate-butadiene), poly(styrene-isoprene), poly (methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylonitrile), and poly(styrene-butyl acrylate-acrylononitrile-acrylic acid), and wherein said colorant is a pigment; a process wherein the anionic surfactant is selected from the group consisting of sodium dodecyl sulfate, sodium dodecylbenzene sulfate, sodium dodecyinaphthalene sulfate, and sodium tetrapropyl diphenyloxide disulfonate; a process wherein the colorant is carbon black, cyan, yellow, magenta, or mixtures thereof; a process wherein the toner particles isolated are from about 2 to about 10 microns in volume average diameter, and the particle size distribution thereof is from about 1.15 to about 1.30, wherein the ionic surfactant utilized represents from about 0.01 to about 5 weight percent of the total reaction mixture; a process wherein there is added to the surface of the formed toner metal salts, metal salts of fatty acids, silicas, metal oxides, or mixtures thereof, each in an amount of from about 0.1 to about 10 weight percent of the obtained toner particles; a process which comprises mixing a resin latex, an ionic surfactant and colorant; heating the resulting mixture below about, or equal to about the glass transition temperature of second or shell latex resin; thereafter heating the resulting aggregates above about, or about equal to the glass transition temperature of the resin; and optionally isolating, washing and drying the toner and; a process comprising the preparation, or provision of a latex emulsion comprised of first and second resin particles in the size range of from about 0.5 to about 3 microns, an ionic surfactant, a water soluble initiator and a chain transfer agent; aggregating a colorant dispersion with said latex emulsion and optional additives to form toner sized aggregates; freezing or maintaining the size of aggregates with an anionic surfactant; coalescing or fusing said aggregates by heating; and isolating, washing, and drying the toner.

The present invention is, more specifically, directed to a process comprised of blending an aqueous colorant, especially pigment dispersion containing an ionic surfactant with the generated core-shell latex (in the core-shell polymer latex, the core-shell resin particulates, are typically present in amounts of from about 5 to about 60, and preferably from about 25 to about 50 percent by weight, the water (the dispersing medium) is present in amounts of typically from about 40 to about 94, and preferably from about 50 to about 75 percent by weight, surfactant amounts typically range in amounts of from about 0.01 to about 10, and preferably from about 0.5 to about 5 percent by weight, and residual initiator chain transfer agents and fragments thereof are each present in amounts that typically range from about 0.01 to about 5, preferably from about 0.05 to about 1 percent by weight of the total emulsion polymerization mixture) comprised of core-shell polymer particles, preferably submicron in size, of from, for example, about 0.05 micron to about 0.5 micron in volume average diameter, and an ionic surfactant of opposite charge polarity to that of the ionic surfactant in the colorant dispersion, thereafter heating the resulting flocculent mixture at, for example, from about 35° C. to about 60° C. (Centigrade) to form toner sized aggregates of from about 2 microns to about 20 microns in volume average diameter, and which toner is comprised of polymer, colorant, such as pigment and optionally additive particles, followed by heating the aggregate suspension at, for example, from about 70° C. to about 100° C. to effect coalescence and fusion, or fusing of the components of the aggregates and to form mechanically stable integral toner particles.

The particle size of toner compositions provided by the processes of the present invention in embodiments can be controlled by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 12 percent by weight, an aggregate size of about 7 microns in volume average diameter is obtained at an aggregation temperature of about 53° C.; the same latex will provide an aggregate size of about 5 microns at a temperature of about 48° C. under similar conditions. Moreover, as illustrated in application U.S. Ser. No. 922,437, the disclosure of which is totally incorporated herein by reference, the presence of certain metal ion or metal complexes such as aluminum complex in embodiments enables the coalescence of aggregates to proceed at lower temperature of, for example, less than about 95° C. and with a shorter coalescence time of less than about 5 hours. An aggregate size stabilizer can be added prior to or during the coalescence to primarily prevent the aggregates from growing in size with increasing temperature, and which stabilizer is generally an ionic surfactant with a charge polarity opposite to that of the ionic surfactant in the colorant, especially pigment dispersion.

In embodiments, the present invention is directed to processes for the preparation of toner compositions which comprises blending an aqueous colorant dispersion preferably containing a pigment, such as carbon black, phthalocyanine, quinacridone, or cyan, magneta, RHODAMINE B® type, red, green, orange, brown, and the like, with a cationic surfactant, such as benzalkonium chloride, with the generated core-shell latex derived from the emulsion polymerization of a mixture of different monomers of for example, styrene, butadiene, acrylates, methacrylates, acrylonitrile, acrylic acid, methacrylic acid, and the like, and which latex contains an ionic surfactant such as sodium dodecylbenzene sulfonate and which latex resin is of a size of, for example, from about 0.05 to about 0.5 micron in volume average diameter; heating the resulting flocculent mixture at a temperature ranging from about 35° C. to about 60° C. for an effective length of time of, for example, 0.5 hour to about 2 hours to form toner sized aggregates; and subsequently heating the aggregate suspension at a temperature at or below about 95° C. to provide toner particles; and cooling, and isolating the toner product by, for example, filtration, washing and drying in an oven, fluid bed dryer, freeze dryer, or spray dryer.

The present invention includes a process for the preparation of toner comprised of polymer and colorant comprising (0) the preparation, or provision of a latex emulsion comprising a core/shell with at least two different polymers, wherein the core and the shell polymers have different monomer compositions or chain transfer agent concentrations, wherein the polymeric core composition are selected in a manner to provide a glass transition temperature (Tg) in the core of about 20° C. to about 50° C., and preferably about 30° C. to about 50° C., and a weight average molecular weight (Mw) of about 5,000 to about 30,000, and preferably of about 8,000 to about 25,000, and the polymeric shell composition which encapsulates the core are selected to provide a Tg in the shell of about 50° C. to about 70° C., and preferably about 55° C. to about 65° C., and a Mw of 30,000 or higher, preferably of about 40,000 to about 100,000, and which are in the size diameter range of from about 0.05 to about 0.3 microns in volume average diameter; an ionic surfactant, a water soluble initiator and a chain transfer agent;

(i) blending an aqueous colorant like a pigment dispersion containing an ionic surfactant with the latex emulsion containing the nonionic surfactant and an ionic surfactant with a charge polarity opposite to that of the ionic surfactant in the pigment dispersion;

(ii) heating the resulting mixture at a temperature about 25° C. to about 1° C. below the Tg (glass transition temperature) of the latex polymer to form toner sized aggregates;

(iii) subsequently stabilizing the aggregates with anionic surfactant and heating the stabilized aggregate suspension to a temperature of about 85° C. to about 95° C. to effect coalescence or fusion of the components of aggregates to enable formation of integral toner particles comprised of polymer, colorant, especially pigment and optional additives; and cooling to about 25 degrees Centigrade (iv) isolating the toner product by, for example, filtration, followed by washing and drying; and process comprising (i) preparing an ionic colorant mixture by dispersing a colorant, especially pigment, such as carbon black, HOSTAPERM PINK®, or PV FAST BLUE®, in an aqueous surfactant solution containing a cationic surfactant, such as dialkylbenzene dialkylammonium chloride like SANIZOL B-50® available from Kao or MIRAPOL® available from Alkaril Chemicals, by means of a high shearing device such as a Brinkmann Polytron or IKA homogenizer; (ii) adding a colorant mixture, to the latex emulsion of core/shell polymer particles generated, an anionic surfactant, such as sodium dodecylsulfate, dodecylbenzene sulfonate or NEOGEN R®, thereby causing a flocculation of colorant, and polymer particles and optional additives, such as charge enhancing additives, when present; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymers to form toner sized aggregates of from about 2 microns to about 12 microns in volume average diameter; (iv) and heating the mixture in the presence of additional anionic surfactant at a temperature of 95° C. or below for a duration of, for example, from about 1 to about 5 hours to form 2 to 10 micron toner particles with a particle size distribution of from about 1.15 to about 1.35 as measured by the Coulter Counter; and (v) isolating the toner particles by filtration, washing, and drying. Additives to improve flow characteristics and charge additives, if not initially present, to improve charging characteristics may then be added by blending with the formed toner, such additives including AEROSILS™ or silicas, metal oxides like tin, titanium and the like, metal salts of fatty acids like zinc stearate, mixtures thereof, and the like, and which additives are present in various effective amounts, such as from about 0.1 to about 10 percent by weight of the toner for each additive.

The core polymers selected for the process of the present invention include known polymers such as poly(styrene-butadiene), poly(methyl methacrylate-butadiene), poly (ethyl methacrylate-butadiene), poly(propyl methacrylate-butadiene), poly(butyl methacrylate-butadiene), poly (styrene-isoprene), poly(methyl methacrylate-isoprene), poly(ethyl methacrylate-isoprene), poly( propyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly (methyl methacrylate-butadiene-methacrylic acid), poly (methyl methacrylate-butadiene-acrylonitrile-acrylic acid), poly(methyl methacrylate-butyl acrylate-acrylic acid), poly (methyl methacrylate-butyl acrylate-methacrylic acid), poly (methyl methacrylate-butyl acrylate-acrylononitrile), and poly(styrene-butyl acrylate-acrylononitrile-acrylic acid), and the like, and wherein the shell polymers selected for the process of the present invention include known polymers such as poly(styrene-butadiene), poly(methyl methacrylate-butadiene), poly(styrene-isoprene), poly(methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly( methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid), and the like. The latex polymers, or resins are generally present in the toner compositions of the present invention in various suitable amounts, such as from about 75 weight percent to about 98, or from about 80 to about 95 weight percent of the toner, and the latex size suitable for the processes of the present invention can be, for example, from about 0.05 micron to about 1 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts. More specifically the latex can be comprised of a mixture of two polymers, each in an amount of about 50 weight percent, and wherein the first polymer is poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(methyl methacrylate-butyl acrylate), poly(methyl methacrylate-butyl acrylate-acrylic acid), poly(butyl methacrylate-butyl acrylate), poly(butyl methacrylate-acrylic acid), poly (styrene-butyl acrylate-acrylonitrile-acrylic acid), poly (acrylonitrile-butyl acrylate-acrylic acid), and the second polymer is poly(styrene-butylacrylate), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(methyl methacrylate-butyl acrylate), poly(methyl methacrylate-butyl acrylate-acrylic acid), poly(butyl methacrylate-butyl acrylate), poly(butyl metha or crylate-acrylic acid), poly(styrene-butyl acrylate-acrylonitrile-acrylic acid), poly(acrylonitrile-butyl acrylate-acrylic acid).

Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Patent 3,674,736, the disclosure of which is totally incorporated herein by reference; and polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention.

Various known colorants, such as pigments, selected for the processes of the present invention and present in the toner in an effective amount of, for example, from about 1 to about 20 percent by weight of toner, and preferably in an amount of from about 3 to about 12 percent by weight, that can be selected include, for example, carbon black like REGAL 330®; magnetites, such as Mobay magnetites M08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D640™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorants, include pigment, dye, mixtures of pigment and dyes, mixtures of pigments, mixtures of dyes, and the like.

Examples of initiators selected for the processes of the present invention include water soluble initiators such as ammonium and potassium persulfates in suitable amounts, such as from about 0.1 to about 8 percent and preferably in the range of from about 0.2 to about 5 percent (weight percent). Examples of organic soluble initiators include Vazo peroxides, such as Vazo 64, 2-methyl 2-2'-azobis propanenitrile, Vazo 88, 2-2'-azobis isobutyramide dehydrate in a suitable amount, such as in the range of from about 0.1 to about 8 percent. Known free radical initiators can also be selected as indicated herein, and which initiators can be selected in various suitbake amounts, for example from about 0.5 to about 100, and preferably for example, about 5 to about 50 parts, or weight percent. Examples of chain transfer agents include dodecane thiol, octane thiol, carbon tetrabromide and the like in various suitable amounts, such as in the range amount of from about 0.1 to about 10 percent and preferably in the range of from about 0.2 to about 5 percent by weight of monomer.

Surfactants in effective amounts of, for example, from about 0.01 to about 15, or from about 0.01 to about 5 weight percent of the reaction mixture in embodiments include, for example, anionic surfactants, such as for example, sodium dodecylsulfate (SDS), sodium dodecylbenzene sulfonate, sodium dodecylnaphthalene sulfate, sodium tetrapropyl diphenyloxide disulfonate, dialkyl benzenealkyl, sulfates and sulfonates, abitic acid, available from Aldrich, NEOGEN R™, NEOGEN SC™ obtained from Kao, Biosoft D-40™, obtained from Stepan , Dowfax 2A1™ obtained from Dow Chemical, cationic surfactants, such as for example dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOLTM (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to 4.

Examples of surfactants, which can be added to the aggregates preferably prior to coalescence is initiated can be selected from anionic surfactants, such as for example sodium dodecylbenzene sulfonate, sodium dodecylnaphthalene sulfate, sodium tetrapropyl diphenyloxide disulfonate, dialkyl benzenealkyl, sulfates and sulfonates, abitic acid, available from Aldrich, NEOGEN R™, NEOGEN SC™ obtained from Kao, Biosoft D-40™, obtained from Stepan , Dowfax 2A1™ obtained from Dow Chemical and the like. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant utilized in the coalescence to stabilize the aggregate size against further growth or to minimize further growth with temperature is, for example, from about 0.01 to about 10 percent by weight, and preferably from about 0.5 to about 5 percent by weight of reaction mixture.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, siloxanes, titorium oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,660; 4,858,884; 4,584,253 and 4,563,408, the disclosures of which are totally incorporated herein by reference.

The following Examples are being submitted to further illustrate various pieces of the present invention. These Examples are intended to be illustrative only and are not intended to limit the scope of the present invention.

EXAMPLE I

A core-shell latex polymer comprised of a polymer core of styrene/n-butyl acrylate/acrylic acid/1-dodecanthiol of 75/25/3/4.7 parts (by weight throughout unless otherwise indicated) in composition, and a polymer shell of styrene/n-butyl acrylate/acrylic acid of 75/25/3 parts (by weight) in composition, and an overall 50:50 weight ratio of core:shell based on the initial charge of reactants, was prepared by a semi-continuous, sequential emulsion polymerization process as follows. A 2 liter jacketed glass flask with a stirrer set at 200 rpm, and containing 8.9 grams of anionic surfactant DOWFAX 2A1™ (sodium tetrapropyl diphenyloxide disulfonate, 47 percent active, available from Dow Chemical), 3.0 grams of polyoxyethylene nonyl phenyl ether nonionic surfactant, ANTAROX CA 897™ (70 percent active), and 519 grams of deionized water was purged with nitrogen for 30 minutes while the temperature was maintained at from about 25° C. to 80° C. First-stage Monomer emulsion (core) was prepared by homogenizing a monomer mixture of 203 grams of styrene, 67 grams of n-butyl acrylate, 8.1 grams of acrylic acid, and 12.7 grams of 1-dodecanethiol) with an aqueous solution (2.2 grams of DOWFAX 2A1™, 0.8 grams of ANTAROX CA-897™, and 125 grams of deionized water) at 10,000 rpm for 5 minutes at room temperature of about 25° C. by a VirTishear Cyclone Homogenizer. Second-stage Monomer emulsion (shell) was prepared by homogenizing a monomer mixture (203 grams of styrene, 67 grams of n-butyl acrylate, and 8.1 grams of acrylic acid) with an aqueous solution (2.2 grams of DOWFAX 2A1™, 0.8 grams of ANTAROX CA-897™, and 125 grams of deionized water) at 10,000 rpm for 5 minutes at room temperature of about 25° C. by a VirTishear Cyclone Homogenizer. Twenty one (21) grams of seed was removed from the first-stage monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 398 grams of first-stage monomer emulsion were then fed continuously into the reactor over 2 hours and 10 minutes. At the conclusion of the first-stage monomer emulsion feed, the resulting batch was held at 80° C. for 10 minutes. A second-stage Monomer emulsion was then fed continuously into the reactor over 2 hours and 20 minutes. The nitrogen purge was reduced to a slow trickle to maintain a small positive pressure. After the above second-stage monomer emulsion addition was completed, the reaction was allowed to post react for 120 minutes at 80° C., then cooled to 25° C. by cold water. The resulting core-shell latex polymer possessed a bimodal molecular weight distribution, with a high molecular weight shell having an Mw of 61,000 and a low molecular weight core having an Mw of 9,500, as determined on a Waters GPC. The resulting latex has an average mid-point Tg of 50.7° C., as measured on a Seiko DSC. The latex product includes both core and shell polymer This core-shell latex resin possessed an volume average diameter of 151 nanometers as measured by light scattering technique on a Coulter N4 Plus Particle Sizer.

260.0 Grams of the above prepared core-shell latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 43° C. for 1.5 hours, then heated at 48° C. for 1 hour before 26 milliliters of 20 percent aqueous of an anionic surfactant BIOSOFT D-40™ solution were added. Aggregates with a particle size (volume average diameter) of 6.8 microns with a GSD=1.17, as measured on the Coulter Counter, were obtained. Subsequently, the mixture was heated to 93° C. and held there for a period of 1.5 hours before cooling down to room temperature, about 25° C. throughout, filtered, washed with water, and dried in a freeze dryer. The final toner product evidenced a particle size of 7.1 microns in volume average diameter with a particle size distribution of 1.18 as measured on a Coulter Counter.

The resulting toner, that is the above final toner product, was comprised of about 93 percent of core-shell latex polymer, and Cyan Pigment 15:3, about 7 percent by weight of toner, with an volume average diameter of 7.1 microns and a GSD of 1.18, indicating that one can retain toner particle size and GSD achieved in the aggregation step during coalescence without the aggregates falling apart, or separating and without an excessive increase in particle size, when a core-shell polymer latex was prepared via the sequential semicontinuous emulsion polymerization process.

Standard fusing properties of the prepared toner compositions were evaluated as follows: unfused images of toner on paper with a controlled toner mass per unit area of 0.55 milligrams/cm$^2$ were produced by one of a number methods. A suitable electrophotographic developer was produced by mixing from 2 to 10 percent by weight of the toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured by the Faraday Cage. The developer was introduced into a small electrophotographic copier, such as Mita DC-111, in which the fuser system had been disconnected. Between 20 to 50 unfused images of a test pattern consisting of a 65 millimeter by 65 millimeter square solid area were produced on 8.5 by 11 inch sheets of a typical electrophotographic paper such as Xerox Corporation Image LX paper.

The unfused images were then fused by feeding them through a hot roll fuser consisting of a fuser roll and pressure roll with elastomer 5 surfaces, both of which are heated to a controlled temperature. Fused images were produced over a range of hot roll fusing temperatures from about 130° C. to about 210° C. The gloss of the fused images was measured according to TAPPI Standard T480 at a 75° C. angle of incidence and reflection using a Novo-Gloss Statistical Gloss Meter, Model GL-NG 1002S from Paul N. Gardner Company, Inc. The degree of permanence of the fused images was evaluated by the Crease Test (crease test data can be expressed as MFT). The fused image was folded under a specific weight with the toner image to the inside of the fold. The image was then unfolded and any loose toner wiped from the resulting Crease with a cotton swab. The average width of the paper substrate, which shows through the fused toner image in the vicinity of the Crease, was measured with a custom built image analysis system.

The fusing performance of a toner is traditionally judged from the fusing temperatures required to achieve acceptable image gloss and fix. For high quality color applications, an image gloss greater than 50 gloss units is preferred. The minimum fuser temperature required to produce a gloss of 50 is defined as $T(G_{50})$ for a given toner. Similarly, the minimum fuser temperature required to produce a Crease value less than the maximum acceptable Crease is known as the Minimum Fix Temperature (MFT) for a given toner, In general, it is desirable to have both $T(G_{50})$ and MFT as low as possible, such as for example $T(G_{50})$ is below 200° C., and preferably below 190° C., and MFT is below 190° C., and preferably below 170° C. in order to minimize the power requirements of the hot roll fuser.

Fusing evaluation showed that the toner of this Example had a $T(G_{50})$ of 184° C. and an MFT of 162° C., as compared to a prior art toner without the specific above curel shall polymers wherein the $T(G_{50})$ is f 179° C. to about 195° C. and the MFT is of 165° C. to about 180° C.

EXAMPLE II

A core-shell latex polymer comprised of a polymer core of styrene/n-butyl acrylate/acrylic acid/1-dodecanthiol of 70/30/3/4 parts (by weight) in composition, and a polymer shell of styrene/n-butyl acrylatelacrylic acid/1-dodecanthiol of 78/22/3/1.6 parts (by weight) in composition, and an overall 33:67 weight ratio of core:shell based on the initial charge of reactants, was prepared by a semi-continuous, sequential emulsion polymerization process as follows. A 2 liter jacketed glass flask with a stirrer set at 200 rpm, and containing 8.9 grams of anionic surfactant DOWFAX 2A1™ (47 percent active), 3.0 grams of nonionic surfactant ANTAROX CA 897™ (70 percent active), and 519 grams of deionized water was purged with nitrogen for 30 minutes while the temperature was from about 25° C. to 80° C. First-stage Monomer emulsion (core) was prepared by homogenizing a monomer mixture (126 grams of styrene, 54 grams of n-butyl acrylate, 5.4 grams of acrylic acid, and 7.2 grams of 1-dodecanethiol) with an aqueous solution (1.5 grams of DOWFAX 2A1™, 0.5 grams of ANTAROX CA-897™, and 83 grams of deionized water) at 10,000 rpm for 5 minutes at room temperature of about 25° C. by a VirTishear Cyclone Homogenizer. Second-stage Monomer emulsion (shell) was prepared by homogenizing a monomer mixture (279 grams of styrene, 81 grams of n-butyl acrylate, 10.8 grams of acrylic acid, and 5.8 grams of 1-dodecanethiol) with an aqueous solution (3.0 grams of DOWFAX 2A1™, 1.1 grams of ANTAROX CA-897™, and 167 grams of deionized water) at 10,000 rpm for 5 minutes at room temperature of about 25° C. by a VirTishear Cyclone Homogenizer. Fourteen (14) grams of seed was removed from the first-stage monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 264 grams of first-stage monomer emulsion were fed continuously into the reactor over 1 hour and 30 minutes. At the conclusion of the first-stage monomer emulsion feed, the batch was held at 80° C. for 30 minutes. Second-stage Monomer emulsion were then fed continuously into the reactor over 3 hours and 10 minutes. The nitrogen purge was reduced to a slow trickle to maintain a small positive pressure. After the above second-stage monomer emulsion addition was completed, the reaction was allowed to post react for 120 minutes at 80° C., then cooled to 25° C. by cold water. The resulting latex polymer possessed a bimodal molecular weight distribution, with a high molecular weight shell having an Mw of 41,000 and a low molecular weight core having an Mw of 23,300, as determined on a Waters GPC. The resulting core-shell latex polymer has an average mid-point Tg of 53.7° C., as measured on a Seiko DSC. This core-shell latex resin of core and shell possessed an volume average diameter of 170 nanometers as measured by light scattering technique on a Coulter N4 Plus Particle Sizer.

260.0 Grams of the above prepared core-shell latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 43° C. for 1.5 hours, then heated at 48° C. for 1 hour before 26 milliliters of 20 percent aqueous anionic surfactant BIOSOFT D-40™ solution were added. Aggregates with a particle size (volume average diameter) of 6.9 microns with a GSD=1.17, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 7.2 microns in volume average diameter with a particle size distribution of 1.17 as measured on a Coulter Counter.

The resulting toner, that is the above final toner product, was comprised of about 93 percent of core-shell latex and Cyan Pigment 15:3, about 7 percent by weight of toner, with an volume average diameter of 7.2 microns and a GSD of 1.17, indicating that one can retain toner particle size and GSD achieved in the aggregation step during coalescence without the aggregates falling apart, or separating and without an excessive increase in particle size.

Fusing evaluation showed that the toner of this Example had a $T(G_{50})$ of 178° C. and an MFT of 170° C.

EXAMPLE III

A core-shell latex polymer comprised of a polymer core of styrene/n-butyl acrylate/acrylic acid/1-dodecanthiol of 70/30/3/4 parts (by weight) in composition, and a polymer shell of styrene/n-butyl acrylate/acrylic acid/1-dodecanthiol of 75/25/3/1 parts (by weight) in composition, and an overall 20:80 weight ratio of core:shell based on the initial charge of reactants, was prepared by a semi-continuous, sequential emulsion polymerization process as follows. A 2 liter jacketed glass flask 50 with a stirrer set at 200 rpm, and containing 8.9 grams of anionic surfactant DOWFAX 2A1™ (47 percent active), 3.0 grams of nonionic surfactant ANTAROX CA 897™ (70 percent active), and 519 grams of deionized water was purged with nitrogen for 30 minutes while the temperature was from about 25° C. to 80° C. First-stage Monomer emulsion (core) was prepared by homogenizing a monomer mixture (75.6 grams of styrene, 32.4 grams of n-butyl acrylate, 3.2 grams of acrylic acid, and 4.3 grams of 1-dodecanethiol) with an aqueous solution (0.8 grams of DOWFAX 2A1™, 0.3 grams of ANTAROX CA-897™, and 50 grams of deionized water) at 10,000 rpm for 5 minutes at room temperature of about 25° C. by a VirTishear Cyclone Homogenizer. Second-stage Monomer emulsion (shell) was prepared by homogenizing a monomer mixture (324 grams of styrene, 108 grams of n-butyl acrylate, 13 grams of acrylic acid, and 4.3 grams of 1-dodecanethiol) with an aqueous solution (3.6 grams of DOWFAX 2A1™, 1.3 grams of ANTAROX CA-897™, and 200 grams of deionized water) at 10,000 rpm for 5 minutes at room temperature of about 25° C. by a VirTishear Cyclone Homogenizer. Sixteen (16) grams of seed was removed from the first-stage monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 146 grams of first-stage monomer emulsion were fed continuously into the reactor over 1 hour. At the conclusion of the first-stage monomer emulsion feed, the batch was held at 80° C. for 30 minutes. Second-stage Monomer emulsion was then fed continuously into the reactor over 3 hours and 50 minutes. The nitrogen purge was reduced to a slow trickle to maintain a small positive pressure. After the above second-stage monomer emulsion addition was completed, the reaction was allowed to post react for 120 minutes at 80° C., then cooled to 25° C. by cold water. The resulting core-shell latex polymer possessed a bimodal molecular weight distribution, with a high molecular weight shell having an Mw of 67,000 and a low molecular weight core having an Mw of 15,300, as determined on a Waters GPC. This core-shell latex polymer has an average midpoint Tg of 55.7° C., as measured on a Seiko DSC. The core-shell latex resin possessed an volume average diameter of 183 nanometers as measured by light scattering technique on a Coulter N4 Plus Particle Sizer.

260.0 Grams of the above prepared core-shell latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 45° C. for 1.5 hours, then heated at 50° C. for 1 hour before 25 milliliters of 20 percent aqueous anionic surfactant BIOSOFT D-40™ solution were added. Aggregates with a particle size (volume average diameter) of 7.0 microns with a GSD=1.19, as measured on the Coulter Counter, were obtained. Subsequently, the mixture was heated to 93° C. and held there for a period of 2 hours before cooling down to room temperature, about 25° C. throughout, filtered, washed with water, and dried in a freeze dryer. The final toner product evidenced a particle size of 7.2 microns in volume average diameter with a particle size distribution of 1.22 as measured on a Coulter Counter.

The resulting toner, that is the above final toner product, was comprised of about 93 percent of the core-shell latex polymer and Cyan Pigment 15:3, about 7 percent by weight of toner, with an volume average diameter of 7.2 microns and a GSD of 1.22, indicating that one can retain toner particle size and GSD achieved in the aggregation step during coalescence without the aggregates falling apart, or separating and without an excessive increase in particle size, when the entire core-shell latex particles are present in a toner, which toner can be generated by aggregation and fusing the core-shell with colorant, such as a pigment.

Fusing evaluation showed that the toner of this Example had a $T(G_{50})$ of 1 77° C. and an MFT of 150° C.

EXAMPLE IV

A core-shell latex polymer comprised of a polymer core of styrene/n-butyl acrylate/acrylic acid/1-dodecanthiol of 60/40/3/1.6 parts (by weight) in composition, and a polymer shell of styrene/n-butyl acrylate/acrylic acid/1-dodecanthiol of 85/20/3/1.6 parts (by weight) in composition, and an overall 25:75 weight ratio of core:shell based on the initial charge of reactants, was prepared by a semi-continuous, sequential emulsion polymerization process as follows. A 2 liter jacketed glass flask with a stirrer set at 200 rpm, and containing 8.9 grams of anionic surfactant DOWFAX 2A1™ (47 percent active), 3.0 grams of nonionic surfactant ANTAROX CA 897™ (70 percent active), and 519 grams of deionized water was purged with nitrogen for 30 minutes while the temperature was from about 25° C. to 80° C. First-stage Monomer emulsion (core) was prepared by homogenizing a monomer mixture (81 grams of styrene, 54 grams of n-butyl acrylate, 4.1 grams of acrylic acid, and 2.1 grams of 1-dodecanethiol) with an aqueous solution (1. 1 grams of DOWFAX 2A1™, 0.4 grams of ANTAROX CA-897™, and 63 grams of deionized water) at 10,000 rpm for 5 minutes at room temperature of about 25° C. via VirTishear Cyclone Homogenizer. Second-stage Monomer emulsion (shell) was prepared by homogenizing a monomer mixture (324 grams of styrene, 81 grams of n-butyl acrylate, 12.2 grams of acrylic acid, and 6.1 grams of 1-dodecanethiol) with an aqueous solution (3.3 grams of DOWFAX 2A1™, 1.2 grams of ANTAROX CA-897™, and 188 grams of deionized water) at 10,000 rpm for 5 minutes at room temperature of about 25° C. via VirTishear Cyclone Homogenizer. Twenty one (21) grams of seed was removed from the first-stage monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 185 grams of first-stage monomer emulsion were fed continuously into the reactor over 1 hour and 10 minutes. At the conclusion of the first-stage monomer emulsion feed, the batch was held at 80° C. for 45 minutes. Second-stage Monomer emulsion were then fed continuously into the reactor over 3 hours and 15 minutes. The nitrogen purge was reduced to a slow trickle to maintain a small positive pressure. After the above second-stage monomer emulsion addition was completed, the reaction was allowed to post react for 120 minutes at 80° C., then cooled to 25° C. by cold water. The resulting core-shell latex polymer possessed The resulting latex polymer possessed an bimodal molecular weight distribution, with a high molecular weight shell having an Mw of 73,000 and a low molecular weight core having an Mw of 21,000, as determined on a Waters GPC. The resulting core-shell latex polymer has an average mid-point Tg of 54.4° C., as measured on a Seiko DSC. This core-shell latex resin possessed an volume average diameter of 185 nanometers as measured by light scattering technique on a Coulter N4 Plus Particle Sizer.

260.0 Grams of the above prepared core-shell latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 45° C. for 1.5 hours, then heated at 50° C. for 1 hour before 25 milliliters of 20 percent aqueous anionic surfactant BIOSOFT D-40™ solution were added. Aggregates with a particle size (volume average diameter) of 6.3 microns with a GSD=1.19, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 6.8 microns in volume average diameter with a particle size distribution of 1.23 as measured on a Coulter Counter.

The resulting toner, that is the above final toner product, was comprised of about 93 percent of the above prepared core-shell latex polymer and Cyan Pigment 15:3, about 7 percent by weight of toner, with an volume average diameter of 6.8 microns and a GSD of 1.23, indicating that one can retain toner particle size and GSD achieved in the aggregation step during coalescence without the aggregates falling apart, or separating and without an excessive increase in particle size, when the entire core-shell latex particles are in the toner.

Fusing evaluation showed that the toner of this Example had a $T(G_{50})$ of 186° C. and an MFT of 170° C.

EXAMPLE V

A core-shell latex polymer comprised of a polymer core of methyl methacrylate/n-butyl acrylate/acrylic acid/1-dodecanthiol of 75/25/3/4.7 parts (by weight) in composition, and a polymer shell of styrene/n-butyl acrylate/acrylic acid of 75/25/3 parts (by weight) in composition, and an overall 50:50 weight ratio of core:shell based on the initial charge of reactants, was prepared by a semi-continuous, sequential emulsion polymerization process as follows. A 2 liter jacketed glass flask with a stirrer set at 200 rpm, and containing 8.9 grams of anionic surfactant DOWFAX 2A1™ (47 percent active), 3.0 grams of nonionic surfactant, ANTAROX CA 897™ (70 percent active), and 519 grams of deionized water was purged with nitrogen for 30 minutes while the temperature was maintained at from about 25° C. to 80° C. First-stage monomer emulsion (core) was prepared by homogenizing a monomer mixture of 203 grams of methyl methacrylate, 67 grams of n-butyl acrylate, 8.1 grams of acrylic acid, and 12.7 grams of 1-dodecanethiol) with an aqueous solution (2.2 grams of DOWFAX 2A1™, 0.8 grams of ANTAROX CA-897™, and 125 grams of deionized water) at 10,000 rpm for 5 minutes at room temperature of about 25° C. by a VirTishear Cyclone Homogenizer. Second-stage monomer emulsion (shell) was prepared by homogenizing a monomer mixture (203 grams of styrene, 67 grams of n-butyl acrylate, and 8.1 grams of acrylic acid) with an aqueous solution (2.2 grams of DOWFAX 2A1™, 0.8 grams of ANTAROX CA-897™, and 125 grams of deionized water) at 10,000 rpm for 5 minutes at room temperature of about 25° C. by a VirTishear Cyclone Homogenizer. Twenty one (21) grams of seed was removed from the first-stage monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 398 grams of first-stage monomer emulsion were fed continuously into the reactor over 2 hours and 10 minutes. At the conclusion of the first-stage monomer emulsion feed, the resulting batch was held at 80° C. for 10 minutes. Second-stage monomer emulsion were then fed continuously into the reactor over 2 hours and 20 minutes. The nitrogen purge was reduced to a slow trickle to maintain a small positive pressure. After the above second-stage monomer emulsion addition was completed, the reaction was allowed to post react for 120 minutes at 80° C., then cooled to 25° C. by cold water. The resulting core-shell latex polymer possessed a bimodal molecular weight distribution, with a high molecular weight shell having an Mw of 65,000 and a low molecular weight core having an Mw of 8,900, as determined on a Waters GPC. The resulting core-shell latex has an average mid-point Tg of 52.4° C., as measured on a Seiko DSC. The latex product includes both core and shell polymer This core-shell latex resin possessed an volume average diameter of 173 nanometers as measured by light scattering technique on a Coulter N4 Plus Particle Sizer.

260.0 Grams of the above prepared core-shell latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 43° C. for 1.5 hours, then heated at 48° C. for 1 hour before 26 milliliters of 20 percent aqueous of an anionic surfactant BIOSOFT D-40™ solution were added. Aggregates with a particle size (volume average diameter) of 6.5 microns with a GSD=1.19, as measured on the Coulter Counter, were obtained. Subsequently, the mixture was heated to 93° C. and held there for a period of 1.5 hours before cooling down to room temperature, about 25° C. throughout, filtered, washed with water, and dried in a freeze dryer. The final toner product evidenced a particle size of 6.9 microns in volume average diameter with a particle size distribution of 1.21 as measured on a Coulter Counter.

The resulting toner, that is the above final toner product, was comprised of about 93 percent of core-shell latex polymer, and Cyan Pigment 15:3, about 7 percent by weight of toner, with an volume average diameter of 6.9 microns and a GSD of 1.21, indicating that one can retain toner particle size and GSD achieved in the aggregation step during coalescence without the aggregates falling apart, or separating and without an excessive increase in particle size, when the entire core-shell latex particles are in the toner.

Fusing evaluation showed that the toner of this Example had a $T(G_{50})$ of 186° C. and an MFT of 166° C.

EXAMPLE VI

A core-shell latex polymer comprised of a polymer core of styrene/2-ethylhexyl acrylate/1-dodecanthiol of 70/30/4 parts (by weight) in composition, and a polymer shell of styrene/n-butyl acrylate/acrylic acid/1-dodecanthiol of 75/25/3/1 parts (by weight) in composition, and an overall 20:80 weight ratio of core:shell based on the initial charge of reactants, was prepared by a semi-continuous, sequential emulsion polymerization process as follows. A 2 liter jacketed glass flask with a stirrer set at 200 rpm, and containing 8.9 grams of anionic surfactant DOWFAX 2A1™ (47 percent active), 3.0 grams of nonionic surfactant ANTAROX CA 897™ (70 percent active), and 519 grams of deionized water was purged with nitrogen for 30 minutes while the temperature was from about 25° C. to 80° C. First-stage monomer emulsion (core) was prepared by homogenizing a monomer mixture (75.6 grams of styrene, 32.4 grams of 2-ethylhexyl acrylate, and 4.3 grams of 1-dodecanethiol) with an aqueous solution (0.8 grams of DOWFAX 2A1™, 0.3 grams of ANTAROX CA-897™, and 50 grams of deionized water) at 10,000 rpm for 5 minutes at room temperature of about 25° C. by a VirTishear Cyclone Homogenizer. Second-stage monomer emulsion (shell) was prepared by homogenizing a monomer mixture (324 grams of styrene, 108 grams of n-butyl acrylate, 13 grams of acrylic acid, and 4.3 grams of 1-dodecanethiol) with an aqueous solution (3.6 grams of DOWFAX 2A1™, 1.3 grams of ANTAROX CA-897™, and 200 grams of deionized water) at 10,000 rpm for 5 minutes at room temperature of about 25° C. by a VirTishear Cyclone Homogenizer. Sixteen (16) grams of seed was removed from the first-stage monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 143 grams of first-stage monomer emulsion were fed continuously into the reactor over 1 hour. At the conclusion of the first-stage monomer emulsion feed, the batch was held at 80° C. for 30 minutes. Second-stage monomer emulsion were then fed continuously into the reactor over 3 hours and 50 minutes. The nitrogen purge was reduced to a slow trickle to maintain a small positive pressure. After the above second-stage monomer emulsion addition was completed, the reaction was allowed to post react for 120 minutes at 80° C., then cooled to 25° C. by cold water. The resulting core-shell latex polymer possessed a bimodal molecular weight distribution, with a high molecular weight shell having an Mw of 63,000 and a low molecular weight core having an Mw of 13,400, as determined on a Waters GPC. This core-shell latex polymer has an average mid-point Tg of 54.5° C., as measured on a Seiko DSC. The core-shell latex resin possessed an volume average diameter of 176 nanometers as measured by light scattering technique on a Coulter N4 Plus Particle Sizer.

260.0 Grams of the above prepared core-shell latex emulsion and 220.0 grams of an aqueous cyan pigment dispersion containing 7.6 grams of Cyan Pigment 15:3, and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 45° C. for 1.5 hours, then heated at 50° C. for 1 hour before 25 milliliters of 20 percent aqueous anionic surfactant BIOSOFT D-40™ solution were added. Aggregates with a particle size (volume average diameter) of 6.7 microns with a GSD=1.18, as measured on the Coulter Counter, were obtained. Subsequently, the mixture was heated to 93° C. and held there for a period of 2 hours before cooling down to room temperature, about 25° C. throughout, filtered, washed with water, and dried in a freeze dryer. The final toner product evidenced a particle size of 6.9 microns in volume average diameter with a particle size distribution of 1.20 as measured on a Coulter Counter.

The resulting toner, that is the above final toner product, was comprised of about 93 percent of the core-shell latex polymer, and Cyan Pigment 15:3, about 7 percent by weight of toner, with an volume average diameter of 6.9 microns and a GSD of 1.20, indicating that one can retain toner particle size and GSD achieved in the aggregation step during coalescence without the aggregates falling apart, or separating and without an excessive increase in particle size when the entire core-shell latex particles are in the toner.

Fusing evaluation showed that the toner of this Example had a $T(G_{50})$ of 179° C. and an MFT of 150° C.

Other modifications of the present invention may occur to those skilled in the art subsequent to a review of the present application and these modifications, including equivalents thereof, are intended to be included within the scope of the present invention.

What is claimed is:

1. A process for the preparation of a latex comprising a core polymer and a shell thereover and wherein said core polymer is generated by (A)

(i) emulsification and heating of monomer, chain transfer agent, water, surfactant, and initiator;

(ii) generating a seed latex by the aqueous emulsion polymerization of a mixture comprised of part of the (i) monomer emulsion, from about 0.5 to about 50 percent by weight, and an optional free radical initiator, and which polymerization is accomplished by heating;

(iii) heating and adding to the formed seed particles of (ii) the remaining monomer emulsion of (1), from about 50 to about 99.5 percent by weight of monomer emulsion of (i) and free radical initiator;

(iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of monomer, chain transfer agent, surfactant, and an initiator;

(ii) adding a free radical initiator and heating;

(iii) whereby there is provided said shell polymer.

2. A process for the preparation of a latex comprising forming a (A) core polymer from an aqueous latex containing water and a monomer, and wherein said polymer possesses a glass transition temperature (Tg) of about 20° C. to about 50° C., and a weight average molecular weight (Mw) of about 5,000 to about 30,000, which latex is generated by the emulsion polymerization of a first core monomer by (i) emulsification of the polymerization components of monomer, chain transfer agent, water, surfactant, and initiator, and wherein the emulsification is accomplished at a low temperature of from about 5° C. to about 40° C;

(ii) generating a seed latex by the aqueous emulsion polymerization of a mixture comprised of part of the monomer emulsion (i), from about 0.5 to about 50 percent by weight, and a free radical initiator, from about 0.5 to about 100 percent by weight of total initiator used to prepare the core polymer resin, and which polymerization is accomplished, at a temperature of from about 35° C. to about 125° C. and, wherein the reaction of the free radical initiator and monomer generates a seed latex containing a polymer;

(iii) heating and adding to the formed seed particles of (ii) the remaining monomer emulsion of (i), from about 50 to about 99.5 percent by weight of monomer emulsion of (i) and a free radical initiator, from about 0.5 to about 99.5 percent by weight of total initiator used to prepare the polymer resin and which heating is at a temperature from about 35° C. to about 125° C., and (iv) retaining the above mixture of (iii) at a temperature of from about 35° C. to about 125° C. to provide said core polymer, and wherein said core polymer possesses a glass transition temperature (Tg) of about 20° C. to about 50° C., and a weight average molecular weight (Mw) of about 5,000 to about 30,000, and;

(B) forming a shell thereover said core generated polymer and which shell is generated by emulsion polymerization of a second monomer by polymerizing said second monomer with a glass transition temperature of about 50° C. to about 70° C., and a weight average molecular weight of about 30,000 to about 100,000, and which emulsion polymerization is accomplished by (i) emulsification polymerization of monomer, chain transfer agent, surfactant, and an initiator, and wherein said polymerization is accomplished at a low temperature of from about 5° C. to about 40° C.;

(ii) adding a free radical initiator, from about 0.1 to about 99.5 percent by weight, and heating at a temperature from about 35° C. to about 125° C.; and (iii) retaining the resulting core-shell polymer colloid dispersed in water at a temperature of from about 35° C. to about 125° C., followed by cooling and wherein in the resulting core-shell polymer latex, the core-shell polymer is present in an amount of from about 5 to about 60 percent by weight, the water is present in an amount of from about 40 to about 94 percent by weight, the surfactant is present in an amount of from about 0.01 to about 10 percent by weight, and wherein said polymer core possesses a glass transition temperature (Tg) of about 20° C. to about 50° C., and a weight average molecular weight (Mw) of about 5,000 to about 30,000, said polymer shell possessing a glass transition temperature of about 50° C. to about 70° C., and a weight average molecular weight of about 30,000 to about 100,000, and optionally wherein the polymer shell possesses a thickness of about 0.01 microns to about 0.3 microns.

3. A process in accordance with claim 2 wherein said core polymer possesses a glass transition temperature (Tg) of about 30° C. to about 50° C., and a weight average molecular weight (Mw) of about 8,000 to about 25,000, and said core latex contains about 50 to about 90 percent by weight of water, and from about 65 to about 95 of surfactant, wherein said (ii) seed particle latex contains from about 3 to about 25 percent by weight of the emulsion prepared in (i); adding to the core monomer emulsion in (ii) said free radical initiator in an amount of about 3 to about 100 percent by weight of total initiator used to prepare the core polymer resin, (iv) heating and feed adding to the formed core seed particles of (iii) the remaining monomer emulsion from about 75 to about 97 percent by weight of monomer emulsion prepared in (ii) and free radical initiator from about 0.5 to about 97 percent by weight of total initiator used, and retaining said mixture at a temperature of from about 35° C. to about 125° C. for from about 0.1 to about 10 hours.

4. A process in accordance with claim 1 wherein a toner is prepared by heating the resulting core-shell latex, and a colorant dispersion below about or equal to about the core, or shell polymer latex glass transition temperature to form aggregates, followed by heating above about or equal to about the core, or shell polymer glass transition temperature to coalesce or fuse the aggregates.

5. A process in accordance with claim 4 wherein the latex contains an ionic surfactant, a water soluble initiator and a chain transfer agent; adding anionic surfactant to substantially retain the size of the toner aggregates formed; thereafter coalescing or fusing said aggregates by said heating; and optionally cooling, isolating, washing, and drying the toner.

6. A process in accordance with claim 5 wherein cooling, isolating, washing and drying is accomplished.

7. A process in accordance with claim 4 wherein said core-shell latex surfactant is selected in an amount of from about 0.05 to about 10 weight percent based on the total amount of monomers used to prepare the core-shell latex resin.

8. A process in accordance with claim 4 wherein the temperature at which said aggregation is accomplished controls the size of the aggregates, which temperature is below said polymer glass transition temperature, and wherein the final toner size is from about 2 to about 15 microns in volume average diameter.

9. A process in accordance with claim 8 wherein the aggregation temperature is from about 45° C. to about 55° C., and wherein the coalescence or fusion temperature is from about 85° C. to about 95° C.

10. A process in accordance with claim 4 wherein the colorant is a pigment and wherein said pigment dispersion contains an ionic surfactant, and said latex contains an ionic surfactant of opposite charge polarity to that of ionic surfactant present in said colorant dispersion.

11. A process in accordance with claim 4 wherein a surfactant is utilized in the generation of the colorant dispersion, and which surfactant is a cationic surfactant, an anionic surfactant is present in the latex mixture, wherein the aggregation is accomplished at a temperature of about 15° C. to about 1° C. below the Tg of the latex polymer for a duration of from about 0.5 hour to about 3 hours; and wherein the coalescence or fusion of the components of aggregates for the formation of integral toner particles comprised of colorant, and polymer is accomplished at a temperature of from about 85° C. to about 95° C. for a duration of from about 1 hour to about 5 hours.

12. A process in accordance with claim 4 wherein the there is selected for said core-shell a core polymer of poly(styrene-alkyl acrylate), poly(styrene-1,3-diene), poly (styrene-alkyl methacrylate), poly(styrene-alkyl acrylate-acrylic acid), poly(styrene-1, 3-diene-acrylic acid), poly (styrene-alkyl methacrylate-acrylic acid), poly(alkyl methacrylate-alkyl acrylate), poly(alkyl methacrylate-aryl acrylate-acrylic acid), poly(alkyl methacrylate-acrylic acid), poly(styrene-alkyl acrylate-acrylonitrile-acrylic acid), poly (styrene-1,3-diene-acrylonitrile-acrylic acid), and poly(alkyl acrylate-acrylonitrile-acrylic acid), and a shell polymer of poly(styrene-butadiene), poly(alkyl methacrylate-butadiene), poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1, 3-diene-acrylonitrile-acrylic acid), and poly(alkyl acrylate-acrylonitrile-acrylic acid), and wherein the core polymer is present in an amount of from about 10 to about 60 weight percent, or parts, and the shell polymer is present in an amount of form about 40 to about 90 weight percent or parts.

13. A process in accordance with claim 4 wherein there is selected for said core-shell a core polymer selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(styrene-isoprene), poly (methyl methacrylate-isoprene), poly(ethyl methacrylate-isoprene), poly(propyl methacrylate-isoprene), poly(butyl methacrylate-isoprene), poly(styrene-propyl acrylate), poly (styrene-butyl acrylate), poly(styrene-2-ethylhexyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid); and wherein the shell polymer is poly(styrene-butadiene), poly(methyl methacrylate-butadiene), poly(styrene-isoprene), poly(methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), or poly(styrene-butyl acrylate-acrylononitrile-acrylic acid), and wherein said colorant is a pigment, a dye, or mixtures thereof.

14. A process in accordance with claim 10 wherein the ionic surfactant is an anionic surfactant selected from the group consisting of sodium dodecyl sulfate, sodium dodecylbenzene sulfate sodium dodecylnaphthalene sulfate, and sodium tetrapropyl diphenyloxide disilfonate.

15. A process in accordance with claim 4 wherein the colorant is black, cyan, yellow, magenta, red, blue, green, or mixtures thereof.

16. A process in accordance with claim 4 wherein the toner particles isolated are from about 2 to about 10 microns in volume average diameter, and the particle size distribution thereof is from about 1.15 to about 1.30.

17. A process in accordance with claim 4 wherein there is added to the surface of the formed toner metal salts, metal salts of fatty acids, silicas, metal oxides, or mixtures thereof, each in an amount of from about 0.1 to about 10 weight percent of the obtained toner particles.

18. A process in accordance with claim 4 wherein there is accomplished a heating of the resulting mixture below about, the glass transition temperature of the latex polymer; thereafter heating the resulting aggregates above about, the glass transition temperature of the latex polymer; and cooling, isolating, washing and drying the toner.

19. A process in accordance with claim 18 wherein said toner is of a volume average diameter of from about 1 to about 20 microns.

20. A process in accordance with claim 1 wherein said core polymer is butadiene, isoprene, (meth)acrylates esters, acrylonitrile, (meth)acrylic acid, or mixtures thereof, and wherein said polymer possesses a glass transition temperature (Tg) of about 20° C. to about 50° C., and a weight average molecular weight (Mw) of about 5,000 to about 30,000, and which polymer is present in an amount of from about 5 to about 50, and said water is present in an amount of from about 50 to about 94; and which latex is generated by the emulsion polymerization of a first core monomer by (i) emulsification of the polymerization reagents of monomer, chain transfer agent, water, surfactant, and initiator, and wherein the emulsification is accomplished at a low temperature of from about 5° C. to about 40° C.;

(ii) generating a seed latex by the aqueous emulsion polymerization of a mixture comprised of from about 0.5 to about 50 percent by weight of the (i) monomer emulsion, and a free radical initiator, from about 0. 5 to about 100 percent by weight of total initiator used to prepare the core polymer resin, and which polymerization is accomplished, at a temperature of from about 35° C. to about 125° C. and, wherein the reaction of the free radical initiator and monomer generates a seed latex;

(iii) heating and adding to the formed seed particles of (ii) the remaining monomer emulsion, from about 50 to about 99.5 percent by weight of monomer emulsion of (i) and free radical initiator, from about 0.5 to about 99.5 percent by weight of total initiator used to prepare the polymer resin and which heating is at a temperature from about 35° C. to about 125° C., and (iv) retaining the above mixture of (iii) at a temperature of from about 35° C. to about 125° C. to provide said core polymer comprised of styrene, butadiene, isoprene, (meth)acrylates esters, acrylonitrile, (meth)acrylic acid, of mixtures thereof and wherein said core polymer possesses a glass transition temperature (Tg) of about 20° C. to about 50° C., and a weight average molecular weight (Mw) of about 5,000 to about 30,000, and;

(B) forming a shell thereover said core generated polymer and which shell is generated by emulsion polymerization of a second monomer in the presence of the core by polymerizing a second monomer with a glass transition temperature of about 50° C. to about 70° C., and a weight average molecular weight of about 30,000 to about 100,000, which emulsion polymerization is accomplished by (i) emulsification of the polymerization reagents of monomer, chain transfer agent, surfactant, and an initiator, and wherein said emulsification is accomplished at a low temperature of from about 5° C. to about 40° C.;

(ii) adding (i) said free radical initiator in an amount of about 1 to about 99.5 percent by weight, at a temperature from about 35° C. to about 125° C.; and (iii) retaining the resulting core-shell polymer colloid dispersed in water at a temperature of from about 35° C. to about 125° C. for a period of about 0.5 to about 6 hours, followed by cooling and wherein in the resulting core-shell polymer latex, the core-shell polymer is present in an amount of from about 5 to about 60 percent by weight, the water is present in an amount of from about 40 to about 94 percent by weight, the surfactant is present in an amount of from about 0.01 to about 10 percent by weight, and residual initiator and chain transfer agents and fragments thereof are present in an amount of about 0.01 to about 5 percent by weight of the total emulsion polymerization mixture, said polymer core possessing a glass transition temperature (Tg) of about 20° C. to about 50° C., and a weight average molecular weight (Mw) of about 5,000 to about 30,000, said polymer shell possessing a glass transition temperature of about 50° C. to about 70° C., and a weight average molecular weight of about 30,000 to about 100,000, wherein the polymer shell possesses a thickness of about 0.01 microns to about 0.3 microns, and wherein the latex formed is comprised of a core of a polymer comprising styrene, butadiene, isoprene, (meth)acrylates esters, acrylonitrile, (meth) acrylic acid, and mixtures thereof and a shell of a polymer comprising styrene, (meth)acrylates esters, acrylonitrile, (meth)acrylic acid, and mixtures thereof.

21. A process for the preparation of toner by heating a core-shell latex, wherein the core and the shell thereof are comprised of a polymer, and a colorant dispersion below about or equal to about the shell polymer latex glass transition temperature, followed by heating above about or equal to about the polymer glass transition temperature to coalesce and fuse, and wherein said latex comprising said core polymer and said shell thereover is generated by (i) heating of monomer, chain transfer agent, water, surfactant, and initiator;

(ii) generating a seed latex by the emulsion polymerization of a mixture comprised of part of the (i) monomer emulsion, from about 0.5 to about 50 percent by weight, and an optional free radical initiator, and which polymerization is accomplished by heating;

(iii) heating and adding to the formed seed particles of (ii) the remaining monomer emulsion of (1), from about 50 to about 99.5 percent by weight of monomer emulsion of (i) and free radical initiator;

(iv) whereby there is provided said core polymer; and (B) forming a shell thereover by emulsion polymerization of a second monomer in the presence of the core polymer, which emulsion polymerization is accomplished by (i) emulsification and heating of monomer, chain transfer agent, surfactant, and an initiator;

(ii) adding a free radical initiator and heating;

(iii) whereby there is provided said shell polymer.

22. A process in accordance with claim 21 wherein heating below about or equal to about the shell polymer latex glass transition temperature results in toner aggregates and wherein heating above about or equal to about the polymer glass transition temperature is accomplished to coalesce and fuse the aggregates into a toner.

23. A process in accordance with claim 22 wherein the heating is below about the shell polymer glass transition temperature, and heating to fuse is above about the shell polymer glass transition temperature.

24. A process in accordance with claim 21 wherein the core polymer and shell polymer are dissimilar.

25. A process in accordance with claim 21 wherein the heating is about below the glass transition temperature of the core polymer, and the heating is about above the glass transition temperature of the core polymer.

26. A process in accordance with claim 21 wherein the heating is about below the glass transition temperature of the shell polymer, and the heating is about above the glass transition temperature of the shell polymer.

* * * * *